US005193873A

United States Patent [19]

Juliusz et al.

[11] Patent Number: 5,193,873

[45] Date of Patent: Mar. 16, 1993

[54] SUGAR CANE GRAB

[75] Inventors: Lewinski Juliusz; Sanchez C. Martin; Serwatowski Ryszard, all of Querétaro, Mexico

[73] Assignee: Centro de Investigacion y. Asistencia Tecnica del Estado de Queretaro, A.C., Mexico

[21] Appl. No.: 879,446

[22] Filed: May 1, 1992

Related U.S. Application Data

[63] Continuation of Ser. No. 556,367, Jul. 24, 1990, abandoned.

[30] Foreign Application Priority Data

Dec. 15, 1989 [MX] Mexico ..... 18733

[51] Int. Cl.[5] ..... B66C 3/04

[52] U.S. Cl. ..... 294/106; 294/68.23; 294/88; 37/184

[58] Field of Search ..... 294/106, 68.23, 88; 37/183 R, 184, 188; 414/729, 742

[56] References Cited

U.S. PATENT DOCUMENTS

| | | | |
|---|---|---|---|
| 174,315 | 2/1876 | Smith | 294/68.23 X |
| 1,674,392 | 6/1928 | Flansburg | 37/188 X |
| 1,848,979 | 3/1932 | Stover et al. | 294/68.23 X |
| 2,120,326 | 6/1938 | Doerschlen | 294/68.23 X |
| 2,674,380 | 4/1954 | Boudreaux | 214/9 |
| 2,857,193 | 10/1958 | Heppenstall | 294/106 X |
| 2,874,854 | 2/1959 | Thornton | 214/9 |
| 3,071,265 | 1/1963 | Andre et al. | 214/138 |
| 3,198,567 | 8/1965 | Jongejan et al. | 294/68.23 |
| 3,796,332 | 3/1974 | Kawamura | 294/106 X |
| 4,143,901 | 3/1979 | van Huuksloot | 294/68.23 |
| 4,176,872 | 12/1979 | van Huuksloot | 294/68.23 |
| 4,303,269 | 12/1981 | Faughnan | 294/106 X |
| 4,368,913 | 1/1983 | Brockmann et al. | 294/106 |
| 4,392,774 | 7/1983 | Thomas, Jr. | 294/68.23 X |
| 4,614,476 | 9/1986 | Pinto | 414/729 |
| 5,029,923 | 7/1991 | Bergeron | 294/68.23 |

OTHER PUBLICATIONS

New Developments in Local Cane Harvesting Equipment, The South African Sugar Journal, Dec. 1977.

Mechanized Loading, Sugarland, Oct-Nov 1972, R. R. Downs.

New Grab Loader Developed at Nkwaleni, The South Africa Sugar Journal, Oct. 1967.

*Primary Examiner*—Charles A. Marmor
*Assistant Examiner*—Dean J. Kramer
*Attorney, Agent, or Firm*—Finnegan, Henderson, Farabow, Garrett & Dunner

[57] ABSTRACT

A grab for a sugar can loader suspended from the boom of a tractor having an improved fastening system formed of two mechanical arms that automatically elevate the grab during its closing movement, so that the tips of the grab's tines trace a path parallel to and along the surface of the ground. This avoids ground penetration by the grab's tips, decreasing the pick up of soil and other undersirable materials with the can during its loading.

4 Claims, 8 Drawing Sheets

SUGAR CANE GRAB

This application is a continuation of application Ser. No. 07/556,367, filed Jul. 27, 1990, now abandoned.

BACKGROUND OF THE INVENTION

The present invention relates to an attachment for a sugar cane grab loader formed of two mechanical arms that move the tips of the grab's tines parallel to surface of the ground during closing of the grab, avoiding introduction of soil and other extraneous materials during cane loading.

A known type of mechanical sugar cane loader uses a pushpiler for bundling the cane over the soil and a mechanical grab suspended from a boom of the pushpiler for raising the cane and loading it on trucks. A major problem in the operation of such mechanical sugar cane loaders, is that a significant amount of soil and other extraneous materials is collected with the sugar cane, as well as the destruction of stubs, by the action of the grab and the pushpiler penetrating the ground.

A conventional grab is generally formed of two curved elements articulated at the point of their suspension from the boom. During the closing movement, the grab's tips trace a circular path around the point of their suspension at the boom and they tend to penetrate the soil if the position of elevation of the boom remains constant. To avoid penetration into the ground of the tips of a conventional grab, an operator has to lift the boom simultaneously with closing of the grab. This is very difficult and not very exact. In reality, it is not possible for the operator to avoid at least a partial ground penetration during the alternative action of two hydraulic cylinders, and neither can he avoid leaving some amount of cane on the ground, if the boom rises too quickly. In the case of any cane left on the field, the operator must bundle it again with a pushpiler, spending additional time, and incorporating more undesirable soil with the cane.

Many efforts have been made to avoid soil penetration by the tips of a conventional grab during its closing movement. Some of them consist of a modification to the shape of the grab (South African Patent RSA-807616) or the separation of the articulation points of each grab's elements, but it was still impossible to avoid ground penetration.

The most interesting attempt to solve this problem is shown in U.S. Pat. No. 4,614,476 wherein an auxiliary hydraulic cylinder is connected with the grab and the boom actuating cylinders in such a manner that the actuating pressure of the grab cylinder or the hydraulic fluid expelled during the closing movement of the grab, actuates the auxiliary hydraulic cylinder which at the same time activates the boom cylinders to automatically raise the grab to the desired elevation. Another alternative of the same patentee consists of the use of a servovalve at the boom or at the boom support. When the valve is actuated at the lowest position of the boom, the closing movement of the grab is accompanied by a rising of the boom due to the servohydraulic action between the grab's hydraulic cylinders and the boom. However, the hydraulic interaction between the grab's cylinders and the boom does not guarantee a path of the grab's tips along the surface. Besides, it necessitates an important additional cost to the machine. Considering also a change of the volumetric efficiency of the elements of the hydraulic system used in the machine, the hydraulic interaction between the grab's cylinders and the boom's can vary, thus changing the path of the grab's tips. Accordingly, this alternative does not provide good results when a grab with two hydraulic cylinders is used, such is the situation with many sugar cane loaders.

The present invention has overcome the inconveniences mentioned above with a new and improved mechanical system for fastening a sugar cane grab loader to the boom of a pushpiler.

SUMMARY OF THE INVENTION

The present invention relates to a grab fastening system for sugar cane loaders. The system is formed by two arms articulated like tongs, mounted on a suspended shaft at the end of the boom and pivotally connected to two pairs of lugs welded to the main structure of the grab. The lugs include a pair of bushings and bolts permitting movement of the system with respect to the grab. A characteristic of the grab fastening system is that it avoids ground penetration by the grab's tips decreasing the incorporation of soil and other desirable materials with the cane during its loading. A further characteristic is that it can be used with all conventional grab tips, including the grabs that use one or two hydraulic cylinders and those having one or two points of articulation. An additional characteristic is that the grab can be operated without actuating the hydraulic cylinder of the boom during collection of the cane.

A general objective of the present invention is to provide a device for effectively reducing the amount of soil and other undesirable materials collected by the grab's tips during the picking up of the sugar cane by any type of conventional loader. A second objective of the invention is to provide a system which permits the rising of the grab during its closing, so that their tips can trace a path along the surface without any penetration into the ground.

In accordance with the invention, these objectives are achieved by providing a sugar cane grab comprising a pair of hydraulically actuated tines, each of which is pivotally mounted at one end about a pivot point and having a tip at the other end, the location of said pivot points of said tines being fixed relative to one another so that pivotal movement of the tines brings said tips toward and away from each other in a closing and opening movement, respectively, a pair of arms, each arm being pivotably mounted at one end to a tine intermediate its ends and at the other end to a common shaft axis, said common shaft axis being spaced from and located above said pivot points of said tines, and means for connecting said common shaft axis of said arms to a lifting boom, whereby closing movement of said hydraulically actuated tines causes their pivot points to move toward said common shaft axis and said tips to move toward each other in a plane substantially parallel to a plane passing through said common shaft axis.

DETAILED DESCRIPTION OF THE DRAWINGS

Figure 1:
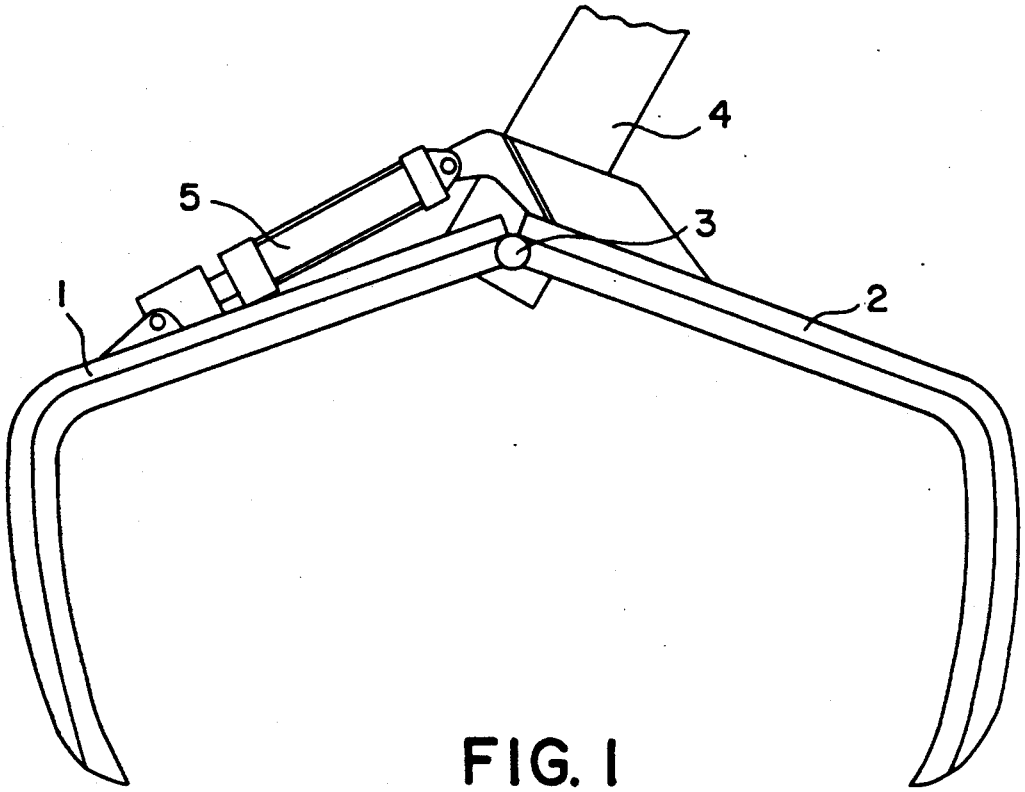
FIG. 1 PRIOR ART
FIG. 1 is a lateral view of a conventional grab having one hydraulic cylinder.
Figure 2:
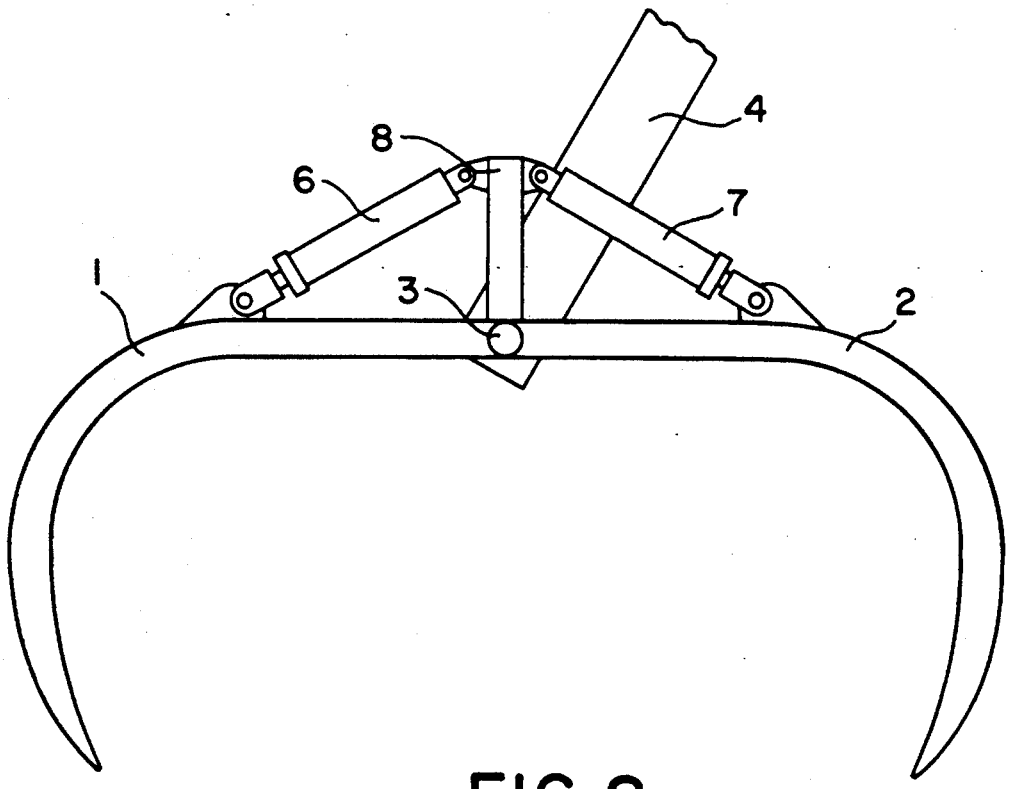
FIG. 2 PRIOR ART
FIG. 2 is a lateral view of a conventional grab having two hydraulic cylinders.
Figure 3A:
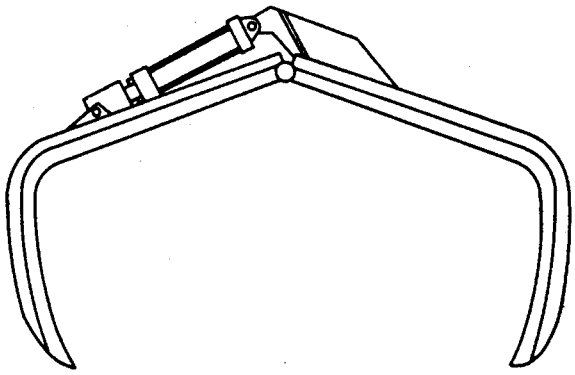
FIG. 3a PRIOR ART
FIGS. 3*a*, 3*b*, 3*c* and 3*d*, are lateral schematic views of the grab of FIG. 1, in different stages of its closing movement.
Figure 3B:
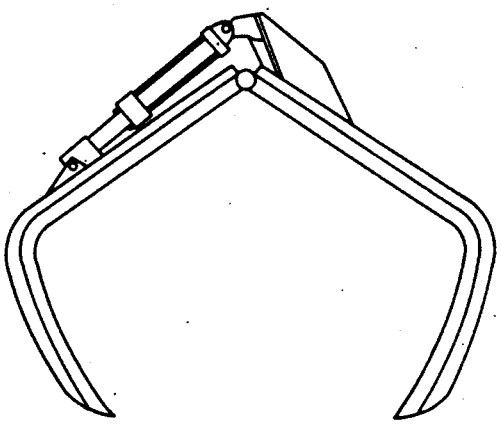
FIG. 3b PRIOR ART
Figure 3C:
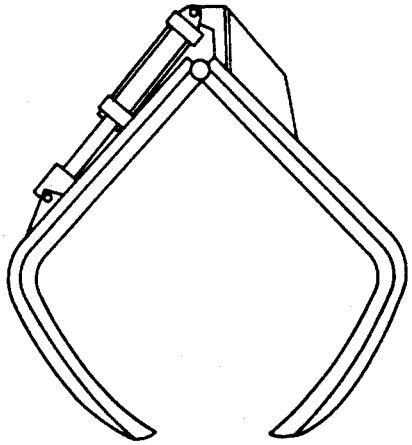
FIG. 3c PRIOR ART
Figure 3D:
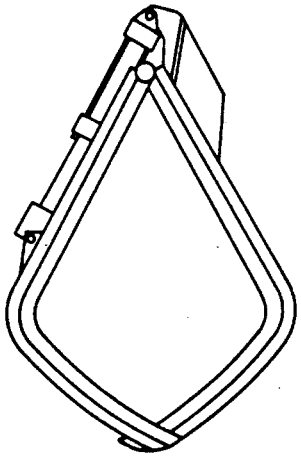
FIG. 3d PRIOR ART
Figure 4A:
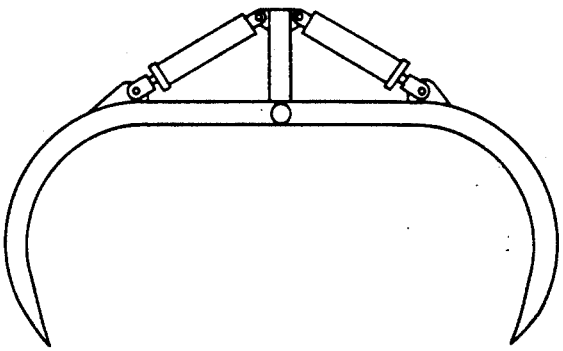
FIG. 4a PRIOR ART
FIGS. 4*a*, 4*b*, 4*c* and 4*d*, are lateral schematic views of the grab of FIG. 2 in different stages of its closing movement.
Figure 4B:
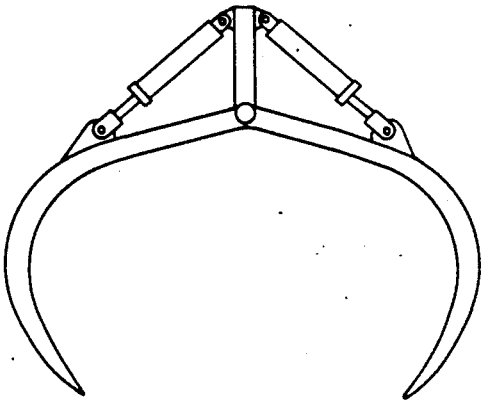
FIG. 4b PRIOR ART
Figure 4C:
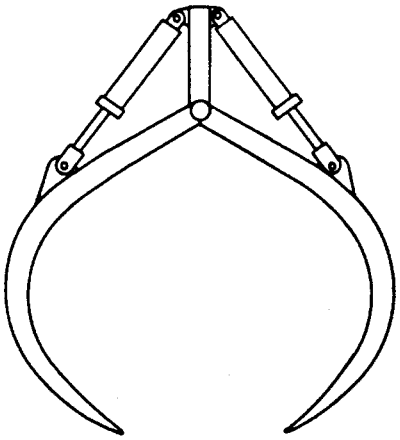
FIG. 4c PRIOR ART
Figure 4D:
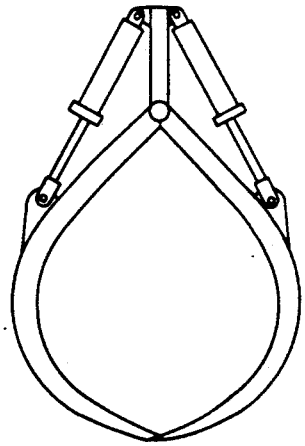
FIG. 4d PRIOR ART

With respect to FIGS. 1 and 2, a conventional grab is formed of two curved elements or tines 1 and 2 pivotally suspended at a single articulation point on a shaft 3 which is fixed to the end of a boom 4 of a tractor or pushpiler. The grab is actuated by one hydraulic cylinder (FIG. 1) or two hydraulic cylinders 6 and 7 (FIG. 2). The grab with two hydraulic cylinders (FIG. 2) has an additional element 8 articulated on the shaft 3 against which the cylinders act. The hydraulic cylinders 6 and 7 actuate depending on the amount of hydraulic flow supplied to the cylinder between element 8 and tines 1 and 2. The opening and closing positions of tines 1 and 2 are limited by the position of the cylinders and their piston stroke.

FIGS. 3*a*–3*d* and 4*a*–4*d* show various positions of the tines of the grabs of FIGS. 1 and 2, respectively, in different stages of their closing movement when the elevation of the boom is constant. As shown, the distance between the shaft 3 and the tips of the tines increases during closing so that the tips would penetrate the ground, presenting the problem of cane contamination. To obtain a grab's tips path parallel to or along the ground surface, the connection point of elements 1 and 2 (shaft 3) would have to be simultaneously raised in an adequate manner. It means that in the case of conventional grabs, the boom has to be simultaneously raised by the action of its hydraulic cylinder.

This movement is done by the operator who thus has to actuate two levers to control the grab and the boom cylinders. However, it is impossible to constantly change the grab's tips path in this way and thus they always penetrate the soil at least partially or leave cane on the ground. In the case of ground penetration, the problem of cane contamination exists if the cane is left in the field. In this case it is necessary to pile it up again by using a pushpiler, thus incorporating even more extraneous material.

Figure 5:
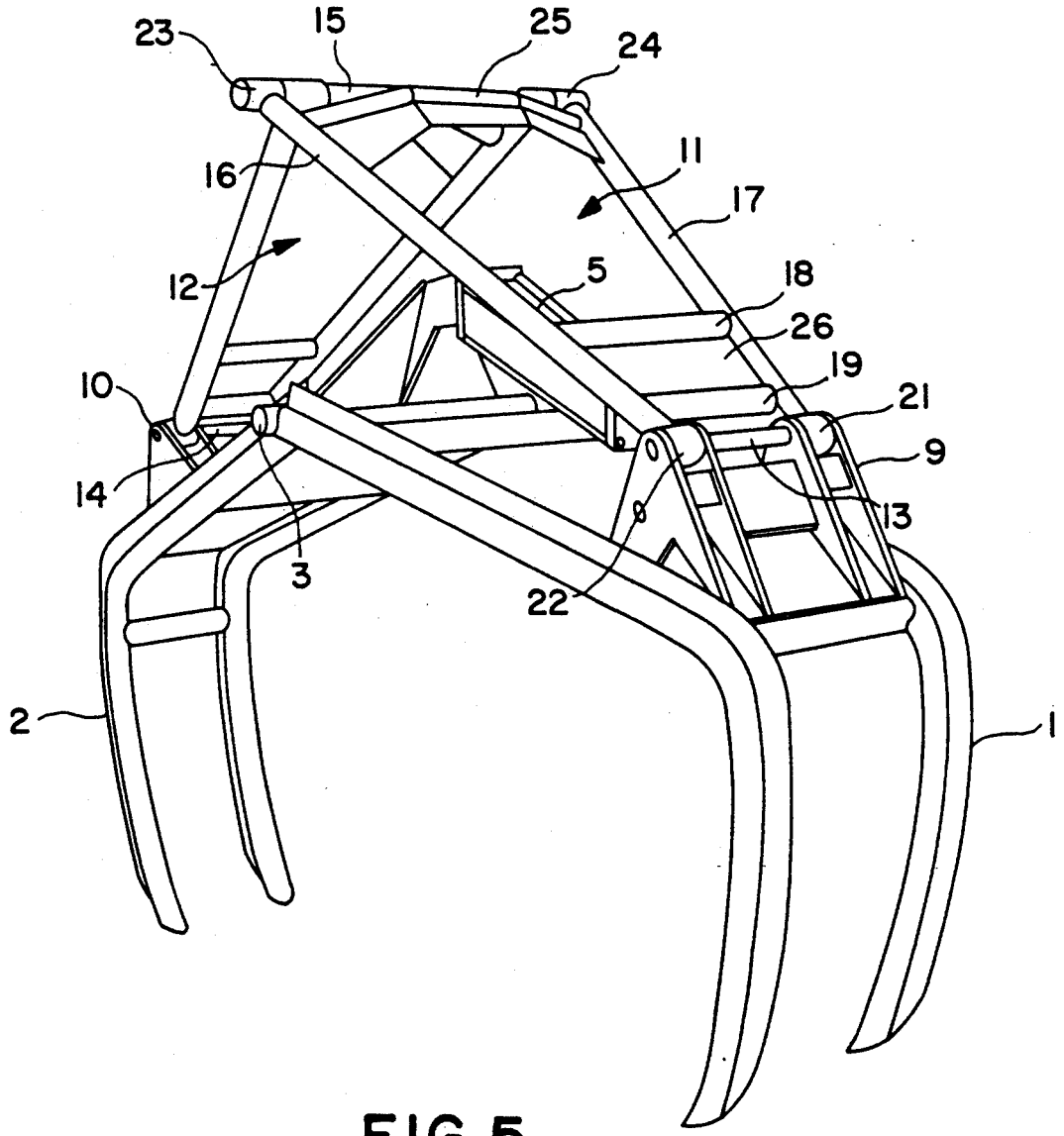
FIG. 5 is a perspective view from one side of the fastening system of the present invention mounted on a conventional grab like that of FIG. 1.
Figure 6:
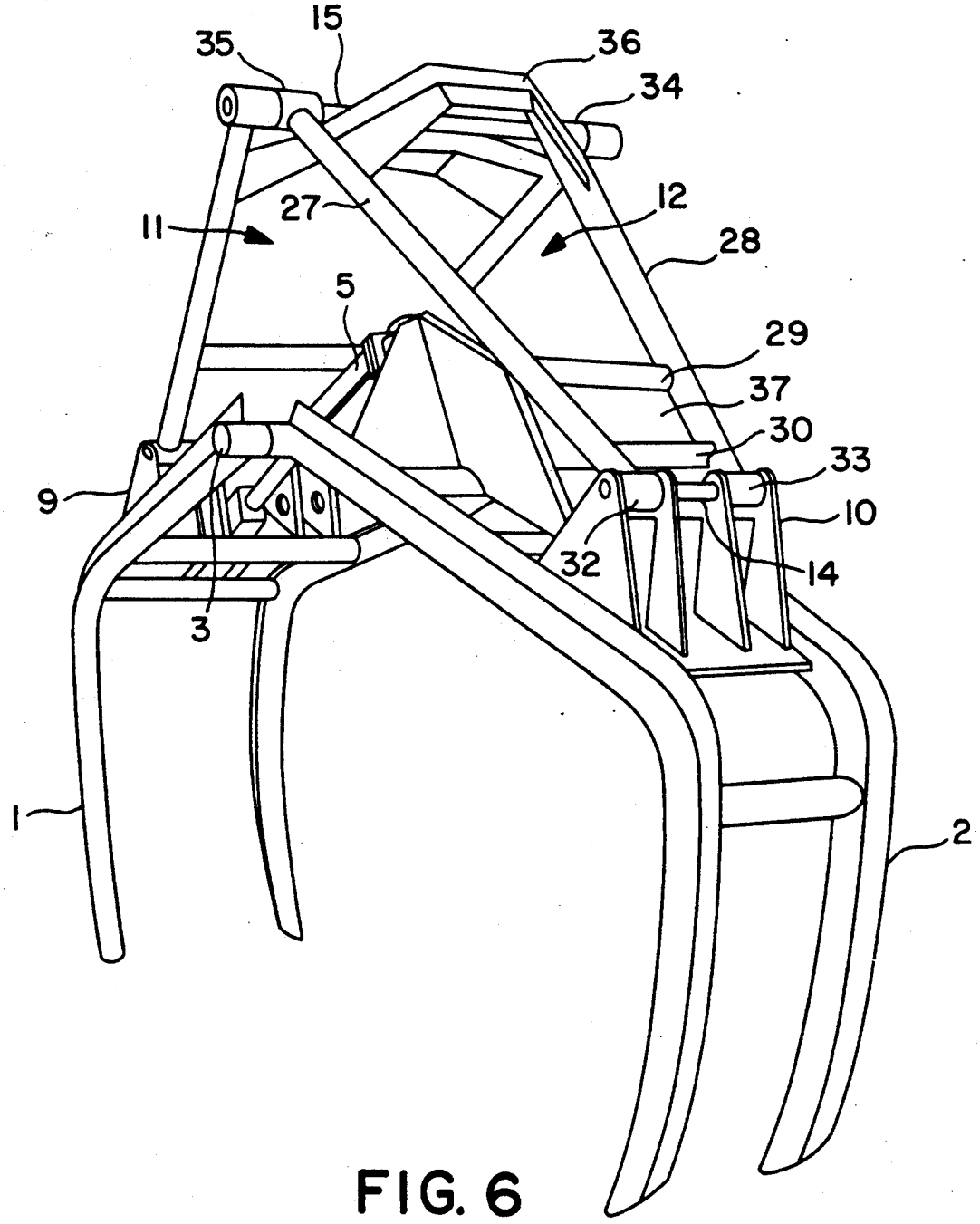
FIG. 6 is a perspective view from the opposite side of the grab of FIG. 5.
Figure 7A:
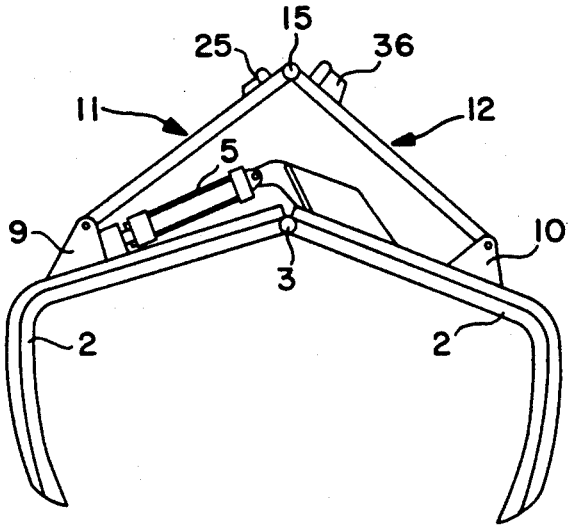
FIGS. 7*a*, 7*b*, 7*c* and 7*d* are lateral schematic views of the grab of FIGS. 5 and 6 in different stages of its closing movement.
Figure 7B:
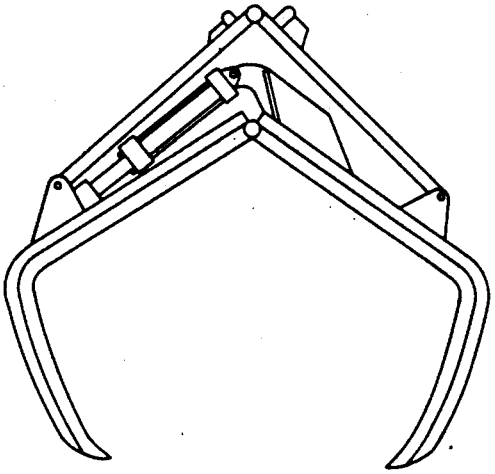
Figure 7C:
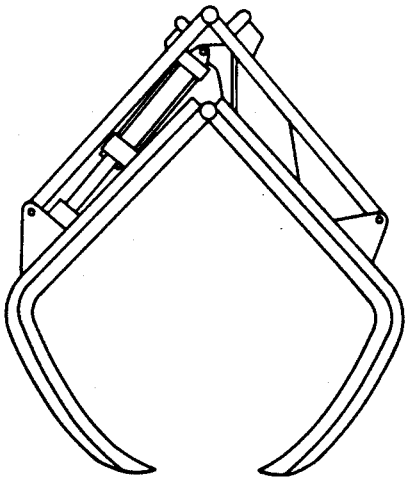
Figure 7D:
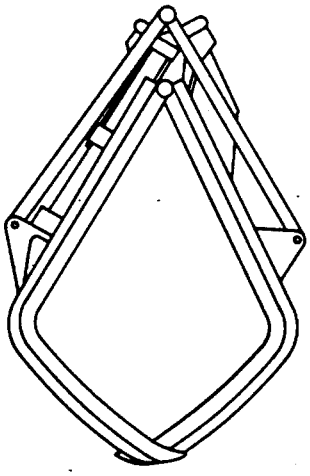
Figure 8A:
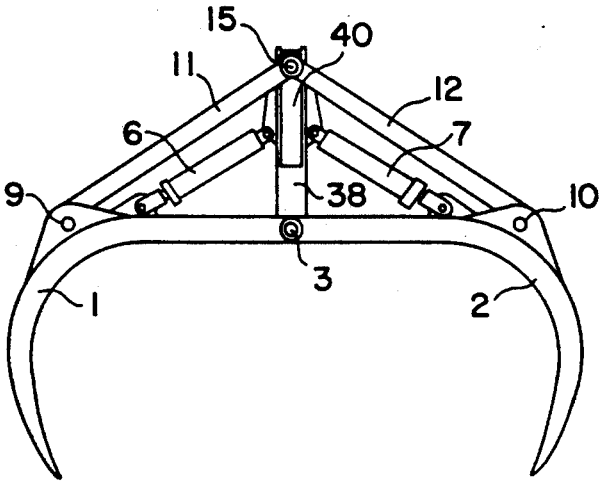
FIGS. 8*a*, 8*b*, 8*c* and 8*d* are schematic lateral views of the fastening system of the invention mounted on a conventional grab like that of FIG. 2 in different stages of its closing movement.
Figure 8B:
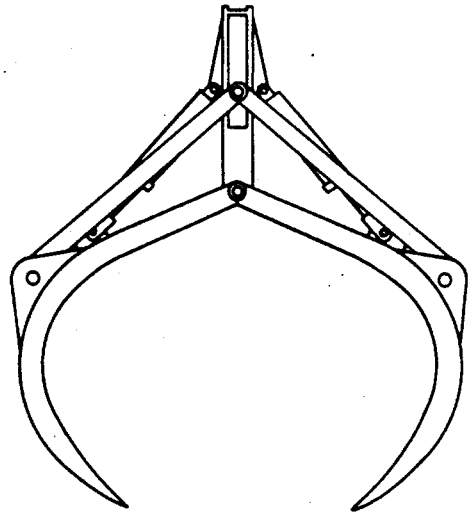
Figure 8C:
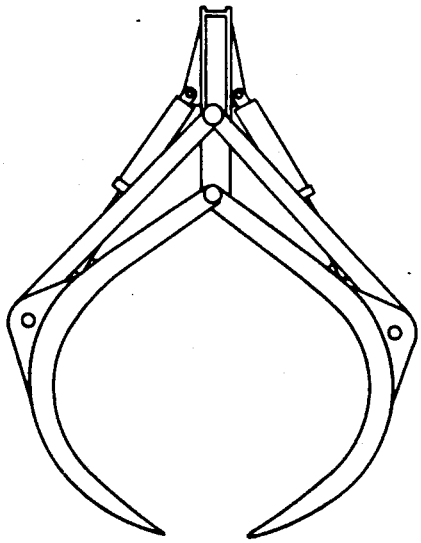
Figure 8D:
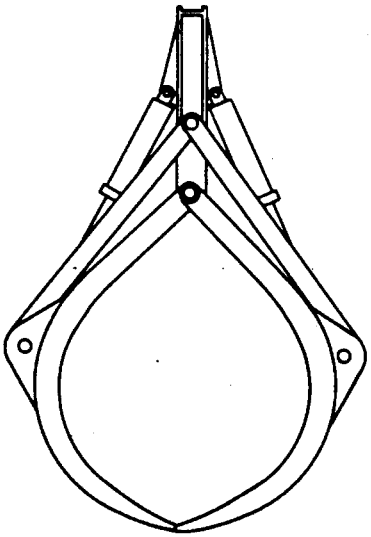

FIGS. 5 and 6 show the grab fastening or suspension system of the present invention. It includes a grab like that of FIG. 1, but additionally has two pairs of lugs 9 and 10 welded to an upper portion of the grab's elements or tines 1 and 2. Arms 11 and 12 of the fastening system are pivotally connected to lugs 9 and 10 by pins 13 and 14. Arms 11 and 12 are articulated at their opposite end on a common shaft 15 which would be connected to the boom (not shown) of a tractor or pushpiler. Front arm 11, as viewed in FIG. 5, is formed by two inclined tubes 16 and 17, two parallel tubes 18 and 19, four sleeves 21, 22, 23 and 24 and two reinforcing plates 25 and 26. All the elements are welded together to form a stiff and rugged structure. Similarly, rear arm 12 (see FIG. 6) consists of two inclined tubes 27 and 28, two parallel tubes 29 and 30, four sleeves 32, 33, 34 and 35 and two reinforcement plates 36 and 37.

Closing movement of the grab, suspended by the fastening system of the present invention, is shown in FIGS. 7*a*–7*d*. The grab is actuated by the hydraulic cylinder 5 which works in the same manner as in a conventional grab. During the grab closing movement, and even with the height of shaft 15 connected to the end of the boom remaining constant, it can be seen that as tines 1 and 2 come together under the action of cylinder 5, arms 11 and 12 will simultaneously pull up the articulation point of the tines on shaft 3, thereby providing the desired path to the grab's tips.

The fastening system of the present invention can be used with all kinds of conventional grabs actuated by one or two hydraulic cylinders. It is only necessary to include two pairs of lugs 9 and 10 on the tines 1 and 2 of the conventional grab to which the two mechanical arms 11, 12 can be pivotally connected. FIGS. 8*a*–8*d* show the different stages of the closing movement of a grab actuated by two hydraulic cylinders using the fastening system of the invention. Again, in this case a pair of lugs 9 and 10 are welded to the grab's tines 1 and 2. Element 8 of the conventional grab of FIG. 2 can be replaced by element 38 articulated on shaft 3 having a slot 40 for guiding shaft 15 during its rising movement and insuring equal work of the two cylinders. Element 38 avoids the possible independent movement of tines 1 and 2, which can occur in conventional 2 cylinder grabs when tines 1 and 2 find different resistance to their movement.

Figure 9:
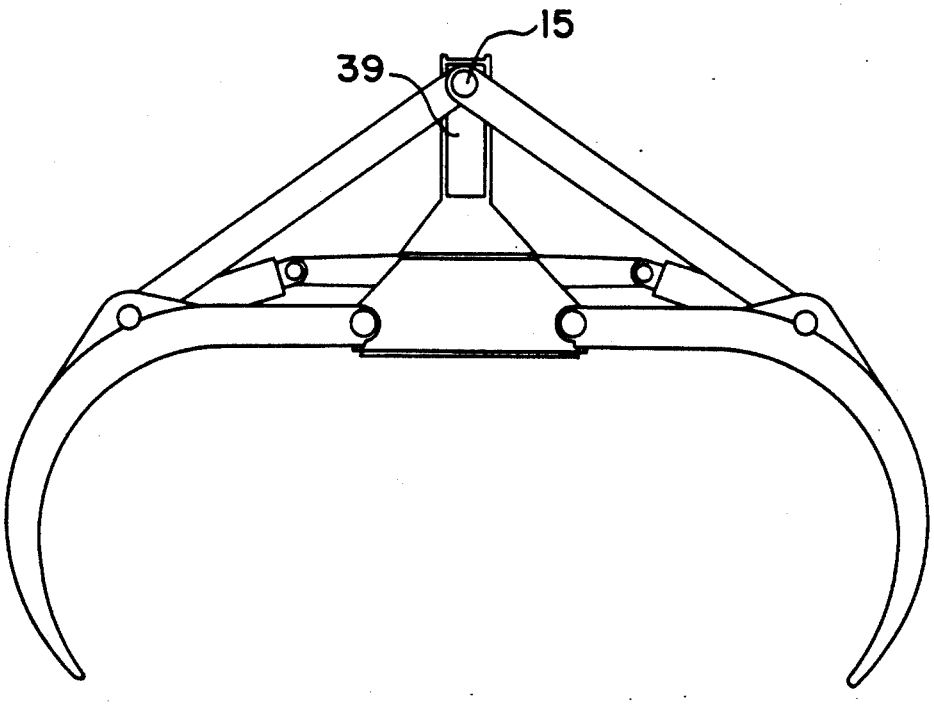
FIG. 9 is a lateral view of the fastening system of the present invention mounted on a grab with two articulation points.

FIG. 9 shows a grab with two articulation points for tines 1 and 2. Here an element 39 has the same structure and function as element 38 in the grab of FIG. 8.

What is claimed is:

1. A sugar cane grab for lifting a bundle of cut cane off of a flat surface comprising a pair of tines, each of which is pivotally mounted at one end about a first common shaft and having a tip at the other end, a pair of hydraulic cylinders, each of which acts between one of said tines and a central support bar extending upwardly from and articulated about said first common shaft to pivot said tines about said first common shaft to thereby bring said tips toward and away from each other in a closing and opening movement, respectively, a linkage mechanism pivotally interconnected between said tines for causing the tips of said tines when they move toward and away from each other in said closing and opening movements to travel in a single plane parallel to and at a constant distance from said flat surface, said linkage mechanism comprising a pair of arms, each arm being pivotably mounted at one end to a tine intermediate its end and at the other end to a second common shaft, said second common shaft being spaced from and located above and in the same vertical plane as said first common shaft, and means for connecting said second common shaft of the linkage mechanism to a lifting boom for holding said second common shaft at a fixed distance above said flat surface during said movements of the tines, whereby closing and opening movement of said tines causes said first common shaft to move, respectively, toward and away from said second common shaft.

2. The sugar cane grab of claim 1, wherein said central support bar includes a guide slot in which said second common shaft is slidably mounted.

3. A sugar cane grab for lifting a bundle of cut cane off a flat surface comprising a pair of tines, each of which is pivotally mounted at one end about a pivot point in a plate and having a tip at the other end, the location of said pivot poitns of said tines in said plate being spaced from one another in the same horizontal plane, a pair of hydraulic cylinders each of which acts between one of said tines and an upwardly extending extension of said plate to pivot each of said tines about its pivot point to thereby bring said tips toward and away from each other in a closing and opening movement, respectively, a linkage mechanism pivotally interconnected between said tines for causing the tips of said tines when they move toward and away from each other in said closing and opening movements to travel in a single plane parallel to and a constant distance from the said flat surface, said linkage mechanism comprising a pair of arms, each arm being pivotably mounted at one end to a tine intermediate its ends and at the other end to a common shaft, said common shaft being spaced from and located above said pivot points of said tines, and means for connecting said common shaft of the linkage mechanism to a lifting boom for holding said common shaft at a fixed distance above said flat surface during said movements of the tines, whereby closing and opening movement of said tines causes said pivot points of the tines to move, respectively, toward and away from said common shaft.

4. The sugar cane grab of claim 3, wherein said extension of said plate includes a guide slot in which said common shaft is slidably mounted.

* * * * *

UNITED STATES PATENT AND TRADEMARK OFFICE

CERTIFICATE OF CORRECTION

PATENT NO. : 5,193,873

DATED : March 16, 1993

INVENTOR(S) : Juliusz Lewinski et al.

It is certified that error appears in the above-identified patent and that said Letters Patent is hereby corrected as shown below:

On the title page, item [75] Inventors:

The inventors' first and last names were incorrectly transposed. Their names should read --Juliusz Lewinski; Martin S. Careaga; Ryszard Serwatowski--;

and

Claim 1, column 4, line 58, "end" (first occurrence) should read --ends--.

Signed and Sealed this

Eleventh Day of January, 1994

Bruce Lehman

*Attest:*

BRUCE LEHMAN

*Attesting Officer*

*Commissioner of Patents and Trademarks*